US008915184B2

(12) United States Patent
Robadey

(10) Patent No.: US 8,915,184 B2
(45) Date of Patent: Dec. 23, 2014

(54) DOCTOR BLADE SYSTEM FOR PRINT UNIT INTENDED FOR A PHOTOGRAVURE PRINTING MACHINE

(75) Inventor: Pierre Robadey, St. Sulpice (CH)

(73) Assignee: Bobst Mex SA (CH)

( * ) Notice: Subject to any disclaimer, the term of this patent is extended or adjusted under 35 U.S.C. 154(b) by 1245 days.

(21) Appl. No.: 12/597,320

(22) PCT Filed: Mar. 28, 2008

(86) PCT No.: PCT/EP2008/002441

§ 371 (c)(1),
(2), (4) Date: Oct. 23, 2009

(87) PCT Pub. No.: WO2008/141694

PCT Pub. Date: Nov. 27, 2008

(65) Prior Publication Data

US 2010/0116158 A1 May 13, 2010

(30) Foreign Application Priority Data

Apr. 27, 2007 (EP) ..... 07008586

(51) Int. Cl.
*B41F 9/10* (2006.01)
*B41F 35/00* (2006.01)
*B41L 41/00* (2006.01)

(52) U.S. Cl.
CPC ..... *B41F 9/1009* (2013.01)
USPC ..... 101/157; 101/155; 101/169

(58) Field of Classification Search
USPC ..... 101/157, 167, 363, 364, 350.1, 425, 101/155, 169
See application file for complete search history.

(56) References Cited

U.S. PATENT DOCUMENTS

| | | | | |
|---|---|---|---|---|
| 2,377,110 A | | 5/1945 | Smith | 101/157 |
| 4,151,797 A | * | 5/1979 | Dunsirn | 101/169 |
| 4,367,120 A | * | 1/1983 | Hendrikz | 162/281 |
| 5,136,941 A | | 8/1992 | Lubke et al. | 101/157 |
| 5,656,083 A | * | 8/1997 | Schonberger | 118/107 |
| 5,676,054 A | | 10/1997 | Lubke et al. | 101/169 |
| 6,283,023 B1 | * | 9/2001 | Christmann et al. | 101/153 |
| 2007/0062387 A1 | * | 3/2007 | Percivalle | 101/157 |

FOREIGN PATENT DOCUMENTS

| | | | | |
|---|---|---|---|---|
| DE | 238 265 C | 5/1910 | | B41F 9/10 |
| DE | 38 41 116 | 9/1989 | | B41F 9/10 |
| EP | 0 072 554 A | 2/1983 | | B41F 9/10 |
| EP | 0 422 344 | 4/1991 | | B41F 9/10 |
| EP | 0 711 662 A | 5/1996 | | B41F 9/10 |
| EP | 0 765 745 | 4/1997 | | B41F 9/10 |
| FR | 2 539 325 | 7/1984 | | B01J 8/00 |
| GB | 474 850 A | 11/1937 | | B41F 9/10 |
| GB | 2 085 363 A | 4/1982 | | B41F 9/10 |
| JP | 62251139 | 10/1987 | | |
| JP | 10071692 | 3/1998 | | |
| JP | 2002225218 | 8/2002 | | |
| JP | 2005034733 | 2/2005 | | |

OTHER PUBLICATIONS

International Search Report dated Jun. 18, 2008, issued in corresponding international application No. PCT/EP2008/002441.

* cited by examiner

*Primary Examiner* — Leslie J Evanisko
*Assistant Examiner* — Marissa Ferguson Samreth
(74) *Attorney, Agent, or Firm* — Ostrolenk Faber LLP

(57) ABSTRACT

A doctor blade system intended for a print unit includes a doctor blade support provided with a blade, an edge of the blade is able to come into contact with a peripheral surface of an engraved printing cylinder, a supporting hub, on which the doctor blade support is mounted, a structure fixing the supporting hub to a frame of the print unit. Apparatus provides a reciprocating motion of the blade along the peripheral surface of the engraved cylinder roughly parallel to the axis of revolution of the engraved cylinder. Thrust elements drive movement of the blade along the direction of the peripheral surface of the engraved cylinder. The reciprocating apparatus directly drives the doctor blade support. The thrust element or elements move the supporting hub and the doctor blade support and the blade to maintain a constant contact over the entire length of the edge of the blade with the peripheral surface of the engraved cylinder.

6 Claims, 2 Drawing Sheets

DOCTOR BLADE SYSTEM FOR PRINT UNIT INTENDED FOR A PHOTOGRAVURE PRINTING MACHINE

CROSS REFERENCE TO RELATED APPLICATION

The present application is a 35 U.S.C. §§371 national phase conversion of PCT/EP2008/002441, filed Mar. 28, 2008, which claims priority of European Application No. 07008586.5, filed Apr. 27, 2007, incorporated by reference herein. The PCT International Application was published in the French language.

BACKGROUND OF THE INVENTION

The present invention relates to a doctor blade system, provided with a doctor blade. The invention also relates to a print unit equipped with a doctor blade system. The invention finally relates to a photogravure printing machine, incorporating at least one print unit.

Photogravure is a rotary printing method that can be used for numerous media, including paper or cardboard, using engraved cylinders. Photogravure printing is used in particular for high quality publication with large print runs where the graphics have to play an important role in the promotion of a product, such as a package in the form of a cardboard box. This printing method makes it possible to print up to ten colors in a single print run, with solvent-based, water-based or other inks: printing matt, glossy or structured varnishes; printing recto and/or verso and embossing.

Thus, in a photogravure printing machine, a print medium in the form of a continuous strip passes through a succession of photogravure print units. The print units are assembled and arranged one after the other from the entry of the print medium upstream to its exit downstream. Each print unit prints a pattern with a single specific color or a particular varnish, or even performs an embossing.

The photogravure principle consists in etching, on the periphery of a printing cylinder, cells that reproduce the pattern that is to be printed. The rotary-driven engraved cylinder is covered with ink by an applicator and rotates inside a tank containing the ink, so filling the cells. The print medium is then pressed heavily against the engraved cylinder, so that the ink contained in the cells can be extracted and transferred to the print medium.

A conventional print unit comprises:

- a print carriage, itself having:
  - an engraved cylinder,
  - an ink applicator, which pours the ink onto the cylinder,
  - an ink fountain, which recovers the ink overflow, and
  - a doctor blade system, which removes the surplus ink from the cylinder by means of a scraping blade, shaving the peripheral surface of the cylinder and leaving only the ink that has penetrated into the cells;
- a layon roll, which presses the print medium strongly onto the cylinder;
- a pump, which routes the ink from the tank to the ink applicator; and
- a dryer, which rapidly evaporates solvents or water, or even polymerizes ink by UV.

While the quality of the printing therefore depends heavily on the quality of the engraved cylinder, the doctor blade system makes it possible to obtain a constant printing quality, by controlling the quantity of ink contained in the cells. The blade is placed in contact with the surface of the cylinder level with a line that immediately precedes, in the direction of rotation of the cylinder, the area in which the cylinder comes into contact with the print medium.

The blade is subjected to a reciprocating motion on the surface of the cylinder, in the direction parallel to the axis of revolution of the cylinder. The angle formed by the plane of the blade with the surface of the cylinder, also known as the angle of incidence, is large to avoid vibration of the blade or to prevent ink trails. The contact pressure of the blade on the cylinder must also be adjusted, to enable the contact surface of the edge of the blade against the cylinder, and the angle of incidence, to remain constant.

The cylinder for photogravure printing is very large and heavy, which on the one hand leads to transport difficulties and on the other hand leads to positioning difficulties. Upon a change of job, the cylinder-tank unit is removed by the removable print carriage, which facilitates its handling and its swapping, as described, for example, in the document FR-2.539.325.

Thus, because of the numerous changes of cylinder, the latter is positioned with deviations in relation to the frame of the print unit. These deviations, constituting a defect of parallel alignment between the blade and the cylinder, generate a separation between the longitudinal edge of the blade and the rotation axis of the cylinder. This phenomenon makes it necessary to have a compensation for the scraping blade.

The cylinder may happen to be engraved at an angle, or the print medium may happen to be skewed inside the print unit. To correct such defects, leading to printing defects, an adjustment technique based on altering the angle of the engraved cylinder, known as "skewing", is used. This deliberate skewing causes a defect of parallel alignment between the cylinder and the blade, which must be corrected to avoid any poor quality scraping.

PRIOR ART

The document DE-38.41.116 discloses a device intended for use in intaglio printing which comprises a doctor blade support provided with a blade. Means for balancing the pressure of the blade are provided and incorporate two lateral support rods onto each of which is driven a spring, bearing against the doctor blade support, and elements for adjusting the hardness of the springs. The doctor blade support, and thus the doctor blade, are also designed to pivot, relative to a central axis, passing through the doctor blade support and perpendicular to the plane formed by the blade. The printing surface is shaved with minimal wear of the doctor blade, the bearing pressure of the doctor blade remaining guaranteed at all points along the doctor blade.

However, such a device presents the drawback of having a pivoting point, which is reflected in the existence of an abutment point for the blade, when it is moved in the direction of the surface to be scraped. The blade will not be able to optimally follow the surface to be scraped.

The document EP-0.765.745 describes a cleaning device, used in intaglio printing, which comprises a doctor blade that can follow the motion of a cleaning roller thanks to a cam-linked mechanism. A support is fixed using pins passing through elongate holes. A hydraulic cylinder is fixed by pins passing through elongate holes. A hydraulic cylinder is fixed to the support, and an actuating portion of the hydraulic cylinder is connected to the doctor blade support. By actuating the hydraulic cylinder, the doctor blade support is moved relative to the support, thanks to elongate openings, enabling the doctor blade support to advance and retract relative to the roller, independently.

However, with such a device, the link mechanism for following the movement of the cleaning roller remains essential to ensure that the blade touches the surface to be wiped. Given that this link mechanism is attached laterally relative to the cylinder and that the hydraulic cylinder is fixed laterally to the support, the contact between the doctor blade and the surface will be very localized at a single point. Furthermore, the elongate openings limit the movements of the doctor blade support.

The document EP-0.422.344 discloses a doctor blade device intended for use with a plate cylinder for photogravure printing. The doctor blade device comprises a blade, a doctor blade support mounted on journals, which are able to pivot relative to corresponding bottom pieces. The bottom pieces, the doctor blade support and thus the doctor blade perform a reciprocating motion along the cylinder. The bottom pieces slide in guides in the direction of the cylinder. Air pistons are mechanically connected and bear directly on the doctor blade support, so as to cause the bottom pieces, the doctor blade support and thus the blade, to slide against the cylinder.

However, the pistons ensure a constant pressure, but only when a portion of the blade is in good contact with the peripheral surface of the cylinder. Furthermore, the presence of the journals for the pivoting means that the thrust of the pistons against the doctor blade support produces undesirable rotational movements. Finally, the reciprocating motion also drives each of the pistons.

DESCRIPTION OF THE INVENTION

One main problem that the invention proposes to address consists in developing a doctor blade system allowing optimal scraping of a peripheral surface of the cylinder. A second problem is to produce a doctor blade system allowing both a reciprocating motion of the blade and optimum cylinder scraping effectiveness using this same blade. A third problem is how to provide a doctor blade system permanently installed in a print unit, while ensuring that it is exactly adapted to each new cylinder. A fourth problem is to use a doctor blade system that is independent of the print carriage and therefore of the cylinder, with a number of options for adjusting the doctor blade system relative to the cylinder. A fifth problem is to obtain a doctor blade system for a print unit, which is both simple and inexpensive to produce. Yet another problem is fitting a doctor blade system in a print unit for photogravure printing machine that makes it possible to obtain a high print quality.

The invention therefore relates to a doctor blade system, intended for a print unit, of the type comprising:

- a doctor blade support provided with a blade, an edge of the blade being able to come into contact with a peripheral surface of an engraved cylinder,
- a supporting hub, on which the doctor blade support is mounted,
- a structure fixing the supporting hub to a frame of the print unit,
- means for providing a reciprocating motion of the blade on the peripheral surface of the engraved cylinder, in a direction roughly parallel to the axis of revolution of said engraved cylinder, and
- one or more thrust elements, driving a movement of the blade in the direction of said peripheral surface of said engraved cylinder.

According to one aspect of the present invention, the doctor blade system is characterized:

- in that the means for providing a reciprocating motion of the blade directly drive the doctor blade support provided with the blade, and
- in that the thrust element or elements bear on the structure and move the supporting hub and the doctor blade support provided with the blade, so as to maintain a constant contact over the entire length of the edge of the blade with the peripheral surface of the engraved cylinder.

In other words with the inventive means, the blade of the doctor blade system will touch and remain constantly in contact with the cylinder, regardless of the angular positioning of the latter relative to the blade. By a free and unimpeded movement of the blade toward the cylinder, its straight edge comes to rest on the peripheral surface and remains abutted thereon over its entire length over the complete rotation of the cylinder. If the cylinder has surface defects, wear or mounting inaccuracies, the means present on the doctor blade system compensate for the differences, whether regular or variable, that exist or occur when the cylinder performs a revolution.

The fine adjustments of the pressure exerted by the edge of the blade on the peripheral surface of the cylinder are not made by the thrust element or elements. The aim is to maintain contact per unit length of the edge of the blade on the peripheral surface of the rotating cylinder. Such contact will be obtained on each change of cylinders, when new jobs are requested.

The reciprocating means are used to avoid excessively fast localized wear of the blade, adversely affecting the print quality. The doctor blade system thus combines for the blade an ability to be moved freely, until the latter comes into and remains constantly in contact with the surface of the cylinder, and a capacity to perform forward and backward movement on this surface of this cylinder. Furthermore, the means for providing reciprocating motion of the blade move only the doctor blade support and its blade, thus reducing the weight of the parts in rapid motion.

Very preferably, the thrust element or elements can generate thrust forces that can be exerted on the supporting hub. These forces can be oriented in the plane defined by the blade. The doctor blade system can comprise two thrust elements, that can advantageously take the form of two springs. These means of applying the thrust for ensuring that the contact is maintained are elastic. These two springs can be positioned laterally, on both sides of the supporting hub, so as to be able to thrust each side of this supporting hub toward the peripheral surface of the engraved cylinder.

Favorably, the system can comprise means for compensating a torque created by the reciprocating motion of the blade. The torque is created by the additional degree of freedom conferred on the supporting hub, on the doctor blade support and on the blade, associated with the reciprocating motion of the doctor blade support and of the blade. The means for compensating the torque can comprise a washer, fitted at one end of a rotation axis of the supporting hub. This rotation axis makes it possible to adjust an angle between the blade and the peripheral surface of the engraved cylinder and constitutes an attachment point between the supporting hub and the structure.

The means for providing a reciprocating motion of the blade can comprise a push arm projecting from the doctor blade support. This finger can come into contact with push means for the reciprocating motion, which are motorized, and independent of the doctor blade system. The means for providing a reciprocating motion of the blade can comprise a return spring, positioned between the doctor blade support and the supporting hub, and ensuring a free return of the doctor blade support, after it has been pushed.

According to a second aspect of the present invention, a print unit is characterized in that it is equipped with a doctor blade system having one or more of the technical features described hereinabove.

According to a third aspect of the present invention, a photogravure printing machine is characterized in that it comprises at least one print unit provided with a doctor blade system having one or more of the technical features described hereinabove.

BRIEF DESCRIPTION OF THE DRAWINGS

The invention will be clearly understood and its various benefits and features will become more apparent from the following description of the nonlimiting embodiment, with reference to the appended diagrammatic drawings in which.

DETAILED EXPLANATION OF THE PREFERRED EMBODIMENTS

Figure 1:
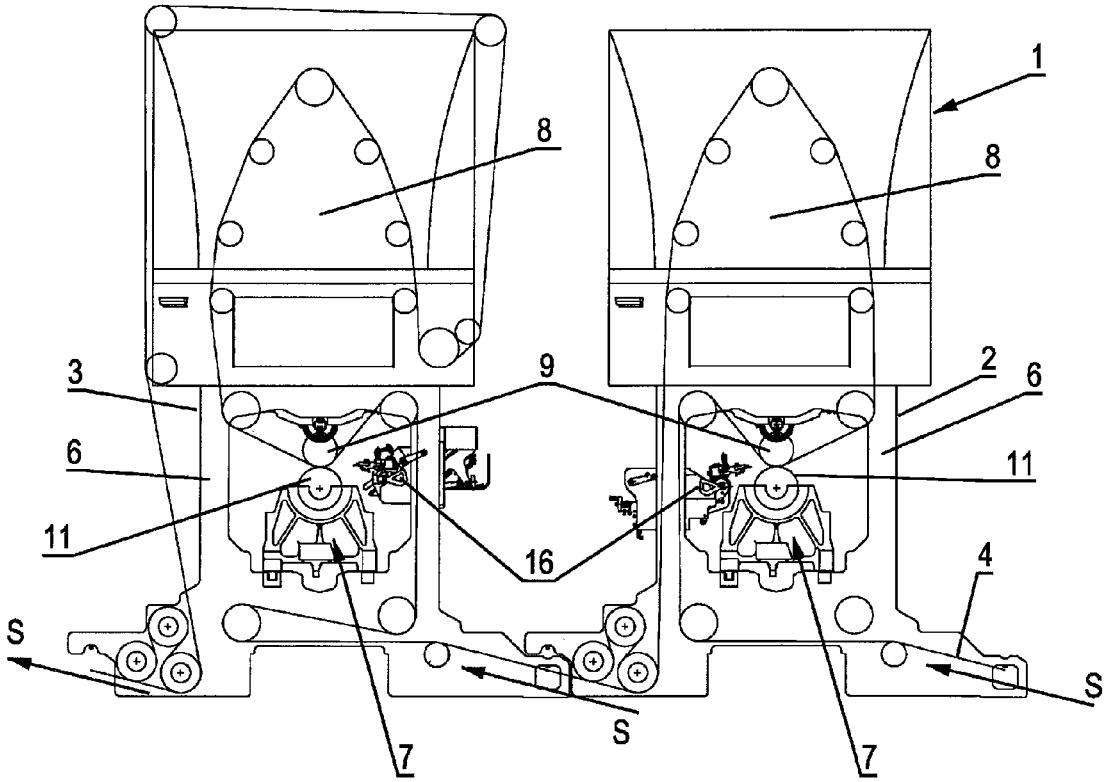
FIG. 1 represents a simplified side view, in elevation, of two successive print units, forming part of a photogravure printing machine.

As illustrated by FIG. 1, a photogravure printing machine (1) is made up of a plurality of print units (2 and 3) mounted in succession one after the other (only two units being represented here). The print medium (4) enters upstream (arrow S in FIG. 1) into the first print unit (2), to be printed with a first color, leaves (S) that unit downstream, then enters (S) upstream into the second print unit (3), to be printed with a second color, and leaves (S) that unit downstream. The print medium (4) can enter and leave as many print units as necessary, to produce the different color prints.

Each print unit (2 and 3) comprises a frame (6), a print carriage (7) inserted at the centre of the frame (6), a dryer (8), a layon roll (9) and a pump (not represented in the figures) that handles the ink feed. Because of the mechanism for routing the print medium (4), the first print unit (2) produces a recto print and the second print unit (3) produces a verso print on this same print medium (4).

Figure 2:
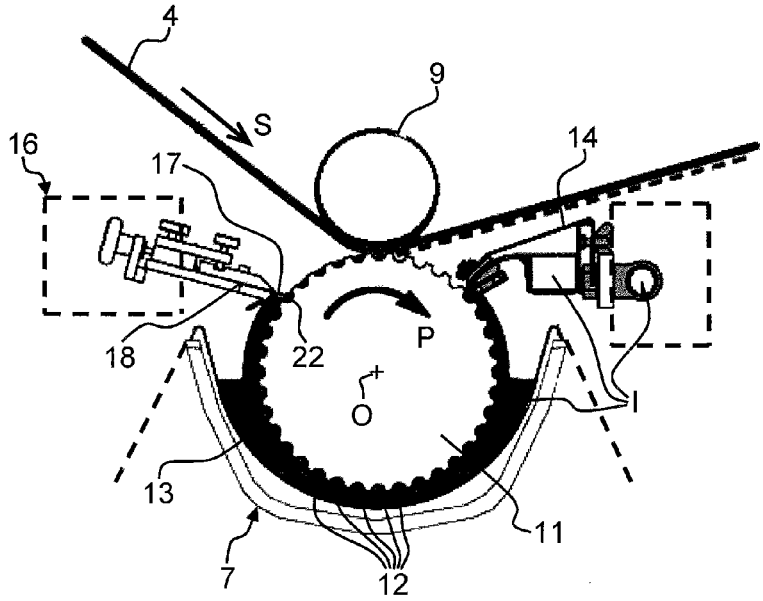
FIG. 2 represents a simplified side view, in elevation, of a print carriage.

The print carriage (7) comprises (see FIGS. 1 and 2) an engraved cylinder (11) with cells (12), rotating (arrow P) relative to its axis of revolution (0) in an ink fountain (13), which recovers the ink overflow (1), and an ink applicator (14), only shown in FIG. 2, fed by the pump. The cells (12) are shown very greatly enlarged in FIG. 2.

Figure 4:
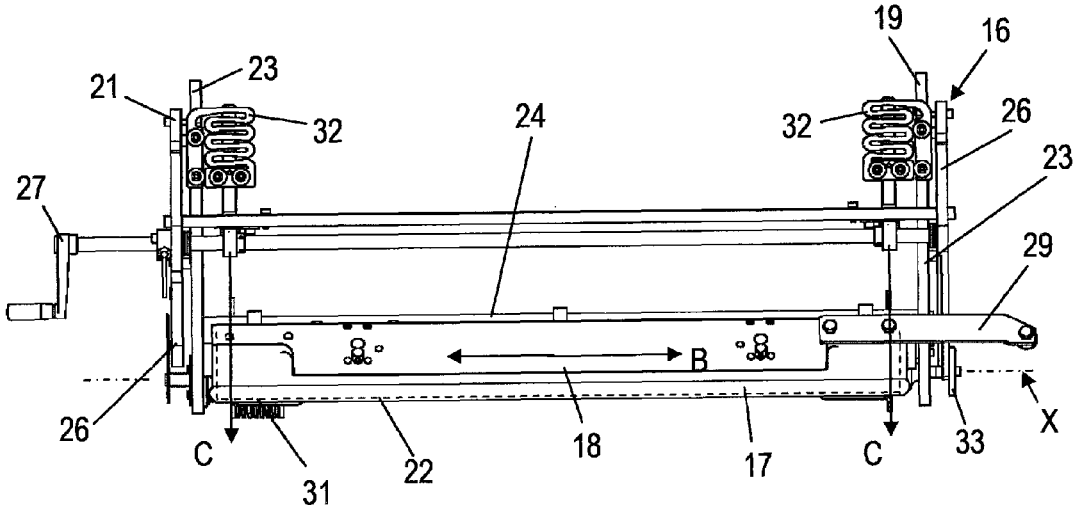
FIG. 4 represents a plan view of the doctor blade system according to the invention.

The print medium (4) is pressed heavily (FIG. 2) against the engraved cylinder (11) by the layon roll (9), so as to transfer the ink (I) contained in the cells (12) of the engraved cylinder (11) to the surface of this medium (4). A doctor blade system (16), which, in this exemplary embodiment is not part of the print carriage (7), wipes the surplus ink (I) from the engraved cylinder (11), by means of a blade (17), which can be seen in FIGS. 2 and 4 (in broken lines).

The doctor blade system (16) is attached to the frame (6) of each print unit (2 and 3). It should be noted that (see FIG. 1), in the case of a recto print, the doctor blade system (16) is provided on the downstream side of the frame (6) of the print unit (2), and in the case of a verso print, the doctor blade system (16) is provided on the upstream side of the frame (6) of the print unit (3).

Figure 3:
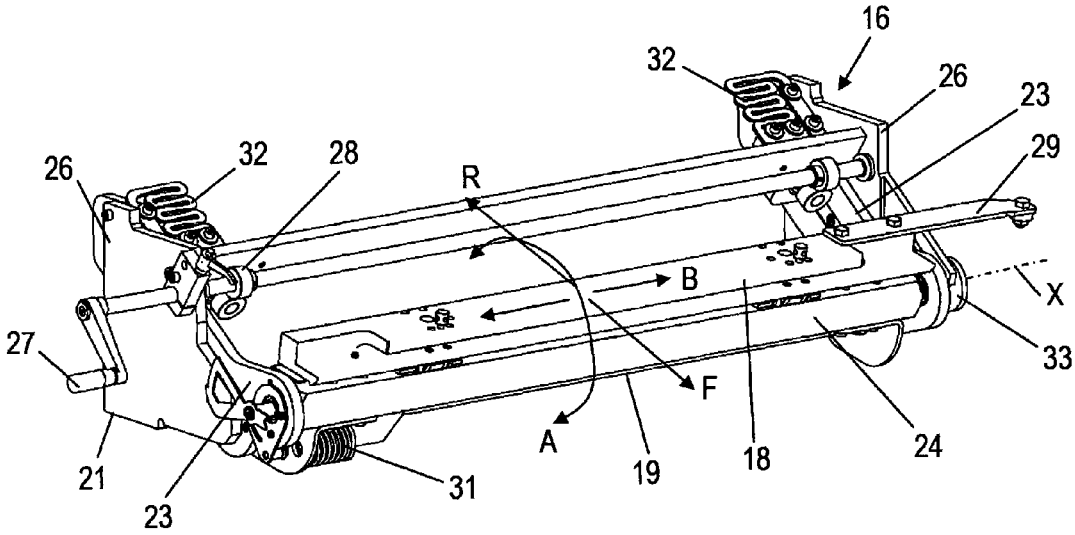
FIG. 3 represents a perspective view of the doctor blade system according to the invention.

The doctor blade system (16) comprises (see FIGS. 3 and 4) a doctor blade support (18), a supporting hub (19) and a structure (21). The blade (17) is inserted into the doctor blade support (18), so that its edge (22) projects and touches the engraved cylinder (11). The supporting hub (19) is produced with two lateral end plates (23) linked by a central part (24). The structure (21) of the doctor blade system (16) is formed by two lateral plates (26) that are fixed onto corresponding uprights of the frame (6).

The doctor blade system (16) comprises means of adjustment according to the format, that is to say, according to the diameter of the engraved cylinder (11). The format adjusting means comprise a crankhandle (27) meshing with a series of pinions (28), to advance (arrow F in FIG. 3) or retract (arrow R in FIG. 3) the supporting hub (19) along two slide rails provided in the structure (21).

The doctor blade system (16) comprises means of adjusting the angle of incidence of the blade (17) relative to the peripheral surface of the engraved cylinder (11), so as to optimize its scraping. These angle adjusting means pivot (arrows A in FIG. 3) the central part (24) of the supporting hub (19), upward and downward relative to the two lateral end plates (23), relative to an axis (X).

The doctor blade system (16) comprises means for making the blade (17) perform a reciprocating motion (arrows B in FIGS. 3 and 4) on the peripheral surface of the engraved cylinder (11). These means comprise a finger (29) that is deployed laterally from the doctor blade support (18). The finger (29) is actuated by motorized means (not represented in the figures), external to the doctor blade system (16). The doctor blade support (18) is mounted in a slide rail (not visible) provided in the top surface of the central part (24) of the supporting hub (19). The doctor blade support (18) has a bottom portion passing through the central part (24) of the supporting hub (19) and bearing against a helical return spring (31).

The reciprocating motion (B) takes place in a direction roughly parallel to the axis of revolution (0) of the engraved cylinder (11). The doctor blade support (18) slides laterally in one direction in the slide rail when thrust by the finger (29), then slides laterally in another direction in the slide rail when thrust back by the helical spring (31).

According to the invention, the doctor blade system (16) comprises means designed to maintain a constant contact over the entire length of the edge (22) of the blade (17) with the peripheral surface of the engraved cylinder (11). These means are two thrust elements, in the form of two springs (32). These two springs (32) are positioned laterally, and act by moving and thrusting (arrows C) each lateral end plate (23) of the supporting hub (19). With this movement of the supporting hub (19), the doctor blade support (18) and the blade (17) are moved toward the peripheral surface of the engraved cylinder (11).

The two laterally placed springs (32) make it possible to exert a differential thrust from one side and/or from the other side of the supporting hub (19). The edge (22) of the blade (17) thus adapts to the irregularities of the peripheral surface and to the engraved cylinder (11) mounting defects and remains pressed firmly against the peripheral surface of the engraved cylinder (11).

Each of the springs (32) is a fixed flat spring respectively bearing on each of the two lateral plates (26) of the structure (21) of the doctor blade system (16). The supporting hub (19) is moved linearly relative to the structure (21) of the doctor blade system (16).

The lateral cheeks (23) of the supporting hub (19) and the two lateral plates (26) of the structure (21) are arranged to allow a movement of the supporting hub (19), of the doctor blade support (18) and of the blade (17) in the same plane as that formed by the blade (17).

When the reciprocating motion (B) of the blade (17) is performed at the same time as a movement to maintain a constant contact over the entire length of the edge (22) of the blade (17) with the peripheral surface of the engraved cylinder (11), an undesirable torque is created in the supporting hub (19). For this, a washer (33) is mounted at one end of a rotation axis (X) of the supporting hub (19) making it possible to adjust (A) an angle between the blade (17) and the peripheral surface of the engraved cylinder (11).

The present invention is not limited to the embodiments described and illustrated. Numerous modifications can be made, without in any way departing from the framework defined by the scope of the set of claims.

The invention claimed is:

1. A doctor blade system for a print unit including a frame and an engraved cylinder including a peripheral surface, the doctor blade system comprising: a doctor blade support;

a doctor blade supported by the doctor blade support, the doctor blade comprising an edge positioned and configured to come into contact with and extend axially along the peripheral surface of the engraved cylinder of the print unit;

a supporting hub, on which the doctor blade support is mounted;

a fixing structure fixing the supporting hub to the frame of the print unit;

a reciprocation apparatus configured and connected to provide reciprocating motion of the doctor blade on the peripheral surface of the engraved cylinder along a direction approximately parallel to an axis of revolution of said engraved cylinder, the reciprocation apparatus for the doctor blade is configured to directly drive the doctor blade support which is provided with the doctor blade;

wherein the reciprocation apparatus for the doctor blade comprises a push finger projecting from the doctor blade support and contacting a reciprocating motion part of the reciprocation apparatus; and a return spring positioned between the doctor blade support and the supporting hub positioned and configured to oppose motion of the doctor blade caused by the push finger; and one or more thrust elements configured and placed to drive the doctor blade in a direction transverse to the axis of revolution and toward the peripheral surface of said engraved cylinder, the one or more thrust elements are positioned and configured to generate forces exerted on the supporting hub, the one or more thrust elements positioned and configured to bear on the fixing structure and to move the supporting hub, and the doctor blade support provided with the doctor blade to maintain a constant contact of the edge of the doctor blade over an entire length of the edge of the doctor blade with the peripheral surface of the engraved cylinder.

2. The system according to claim 1, wherein the one or more thrust elements comprise two thrust elements, each thrust element comprised of a spring, the springs being arranged laterally toward both lateral sides of the supporting hub, and each spring is positioned and configured to thrust its side of the supporting hub in a direction toward the peripheral surface of the engraved cylinder.

3. The system according to claim 1, further comprising a compensation device positioned and configured for compensating a torque created by a reciprocating motion of the doctor blade along a direction of the edge of the doctor blade.

4. The system according to claim 3, wherein the compensation device comprises a washer fitted at one end of an axis of rotation of the supporting hub positioned and configured to enable adjustment of an angle between the doctor blade and the peripheral surface of the engraved cylinder.

5. A print unit including a print cylinder having a peripheral surface that is engraved, and apparatus for supplying ink for printing to the peripheral surface of the cylinder; and a doctor blade system according to claim 1 with a doctor blade positioned and configured to doctor ink at a peripheral region of the print cylinder.

6. A photogravure printing machine, comprising at least one print unit provided with a doctor blade system according to claim 5.

* * * * *